US009004427B2

(12) United States Patent
Irudayaraj et al.

(10) Patent No.: US 9,004,427 B2
(45) Date of Patent: Apr. 14, 2015

(54) MOUNTING AND HINGE ASSEMBLY FOR A SHELF

(75) Inventors: Prashanth Philip Irudayaraj, Atlanta, GA (US); Jeffrey Scott Dolby, Buford, GA (US); Jotpreet Singh Chahal, Norcross, GA (US); Gregory B. Mckenna, Cumming, GA (US); Robert Holcombe, Cumming, GA (US)

(73) Assignee: Alcoa Inc., Pittsbugh, PA (US)

( * ) Notice: Subject to any disclaimer, the term of this patent is extended or adjusted under 35 U.S.C. 154(b) by 338 days.

(21) Appl. No.: 13/402,395

(22) Filed: Feb. 22, 2012

(65) Prior Publication Data

US 2013/0214108 A1 Aug. 22, 2013

(51) Int. Cl.
*A47B 96/06* (2006.01)

(52) U.S. Cl.
CPC ..... *A47B 96/061* (2013.01)

(58) Field of Classification Search
CPC .... G02B 17/006; A47F 5/0846; A47B 96/06; A47B 96/061
USPC ..... 248/250, 200.1, 240.3, 240.4, 225.11, 248/222.13; 312/350; 211/134, 144, 150, 211/153
See application file for complete search history.

(56) References Cited

U.S. PATENT DOCUMENTS

| | | | | | |
|---|---|---|---|---|---|
| 2,042,517 | A | * | 6/1936 | Ellis | 108/135 |
| 3,265,456 | A | * | 8/1966 | Woolever | 312/350 |
| 3,421,458 | A | * | 1/1969 | Nusbaum et al. | 108/134 |
| 3,604,670 | A | * | 9/1971 | Reeves | 248/250 |
| 3,712,698 | A | * | 1/1973 | Propst et al. | 312/350 |
| 4,183,487 | A | * | 1/1980 | Swain | 248/214 |
| 4,320,935 | A | * | 3/1982 | Nagelkirk | 312/350 |
| 4,355,585 | A | * | 10/1982 | Bottamiller et al. | 108/157.13 |
| 4,373,448 | A | * | 2/1983 | Pallotta | 108/29 |
| 4,733,843 | A | * | 3/1988 | Bessinger | 248/250 |
| 4,736,918 | A | * | 4/1988 | Bessinger | 248/250 |
| 4,738,426 | A | * | 4/1988 | Bessinger | 248/250 |
| 4,871,136 | A | * | 10/1989 | Bessinger et al. | 248/250 |
| 4,934,541 | A | * | 6/1990 | Bussan et al. | 211/153 |
| 4,936,641 | A | * | 6/1990 | Bussan et al. | 312/408 |
| 5,205,524 | A | * | 4/1993 | Cohen | 248/235 |
| 5,366,284 | A | * | 11/1994 | Baker et al. | 312/404 |
| 5,384,198 | A | * | 1/1995 | Hodges | 248/466 |
| 5,441,338 | A | * | 8/1995 | Kane et al. | 312/408 |

(Continued)

OTHER PUBLICATIONS

Hunter Douglas Contract: Light Shelves http://www.hunterdouglascontract.com/solarcontrol/lightshelves/index.jsp?trk_semgrp=ligh . . . Obtained Jun. 4, 2012, 1 page.

(Continued)

*Primary Examiner* — Terrell McKinnon
*Assistant Examiner* — Eret McNichols
(74) *Attorney, Agent, or Firm* — Greenberg Traurig, LLP

(57) ABSTRACT

A mounting assembly for connecting a light shelf to a structure in cantilever fashion. A pair of receiver units attach to the structure and each has a pair of brackets with a slot there between. A recess is formed on an upper interior surface of the upper bracket. The lower bracket has an abutment support surface distal to the structure. A pair of inserter units attach to opposite sides of the shelf, each having an insertion leg and an abutment support. The insertion leg inserts into the recess of a corresponding receiver when the abutment support rests on the abutment surface. The weight of the shelf pulls the abutment support into engagement with the abutment surface and pushes the insertion leg into engagement with the recess, holding the shelf horizontally.

23 Claims, 7 Drawing Sheets

(56) References Cited

U.S. PATENT DOCUMENTS

| | | | | |
|---|---|---|---|---|
| 5,454,638 | A * | 10/1995 | Bird et al. | 312/408 |
| 5,485,933 | A * | 1/1996 | Crooymans | 211/90.04 |
| 5,509,634 | A * | 4/1996 | Gebka et al. | 248/316.7 |
| 5,524,981 | A * | 6/1996 | Herrmann et al. | 312/408 |
| 5,738,880 | A * | 4/1998 | Kane et al. | 425/116 |
| 5,799,803 | A * | 9/1998 | Muller | 211/90.01 |
| 5,941,228 | A * | 8/1999 | McKenzie | 126/25 R |
| 6,631,813 | B1 * | 10/2003 | Walter et al. | 211/94.01 |
| 6,648,288 | B2 * | 11/2003 | Matthes | 248/250 |
| 6,663,201 | B2 * | 12/2003 | Herron et al. | 312/245 |
| 6,962,116 | B2 * | 11/2005 | Bienick et al. | 108/108 |
| 6,966,267 | B2 * | 11/2005 | Bienick | 108/108 |
| 7,122,744 | B2 * | 10/2006 | Walter et al. | 174/163 R |
| 7,237,855 | B2 * | 7/2007 | Vardon | 312/408 |
| 7,306,304 | B2 * | 12/2007 | Jang | 312/408 |
| 7,562,630 | B2 * | 7/2009 | Lee et al. | 108/108 |
| 7,843,640 | B2 * | 11/2010 | Hooper, Jr. | 359/596 |
| 7,866,492 | B2 * | 1/2011 | Walter | 211/103 |
| 8,348,210 | B1 * | 1/2013 | Lee | 248/235 |
| 8,684,479 | B2 * | 4/2014 | Bai et al. | 312/408 |
| 2005/0056604 | A1 * | 3/2005 | Chen | 211/182 |
| 2006/0145577 | A1 * | 7/2006 | Daley et al. | 312/408 |
| 2008/0217271 | A1 * | 9/2008 | Walter | 211/89.01 |
| 2010/0117502 | A1 * | 5/2010 | Kang et al. | 312/408 |
| 2010/0270251 | A1 * | 10/2010 | Mejac | 211/134 |
| 2011/0168651 | A1 * | 7/2011 | Stenftenagel et al. | 211/42 |
| 2013/0146553 | A1 * | 6/2013 | Preidt et al. | 211/153 |
| 2013/0186847 | A1 * | 7/2013 | Kramer et al. | 211/134 |
| 2013/0233818 | A1 * | 9/2013 | Gupta | 211/134 |
| 2013/0240471 | A1 * | 9/2013 | Wiese et al. | 211/134 |
| 2013/0248476 | A1 * | 9/2013 | Barenbrugge | 211/134 |
| 2013/0299439 | A1 * | 11/2013 | Sid et al. | 211/134 |
| 2014/0055017 | A1 * | 2/2014 | McMillin et al. | 312/237 |
| 2014/0091696 | A1 * | 4/2014 | Welker et al. | 312/408 |
| 2014/0116973 | A1 * | 5/2014 | Buckley et al. | 211/134 |

OTHER PUBLICATIONS

Tubeblite® Aluminate(TM) Light Shelves http://www.tubeliteinc.com/product_types/aluminate/aluminate.html. Obtained Jun. 4, 2012, 1 page.

WAUSAU Window and Wall Systems, Booth #5048 at Greenbuild 2009, 2 pages.

YKK AP Luminance® Light Shelf System, http://www.ykkap.com/productmaster/Index.aspx?id=7213. Obtained Jun. 4, 2012, 1 page.

E-Lite(TM) Features/Benefits Projects http://www.efcocorp.com/ProductContent.aspx?SecondTab=true&product=80&line=4&typ . . . Obtained Jun. 4, 2012, 2 pages.

InLighten® (Light Shelf) Features EC 97911-09, Kawneer, An Alcoa Company, Feb. 2009, 14 pages.

* cited by examiner

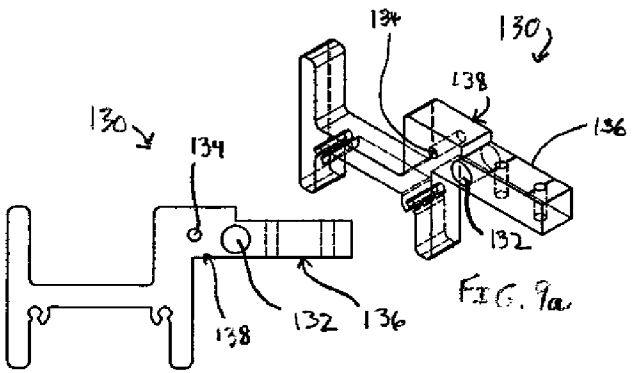
FIG. 9a
FIG. 9b
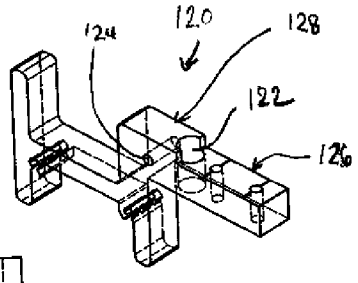
FIG. 8a
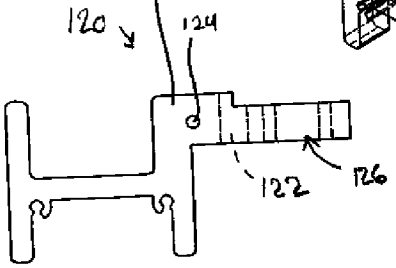
FIG. 8b
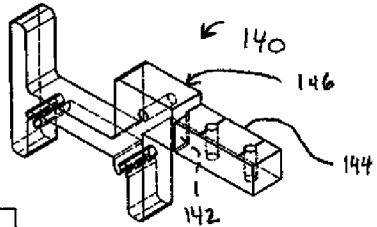
FIG. 10a
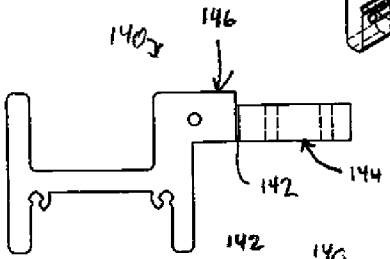
FIG. 10b
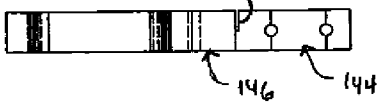
FIG. 10c

MOUNTING AND HINGE ASSEMBLY FOR A SHELF

FIELD

The present invention relates to hinges and supports for mounting a shelf to a structure and more particularly to such apparatus for supporting light shelves.

BACKGROUND

Light shelves are known for redirecting and controlling sunlight that enters a building. Variations on the apparatus and methods for mounting such shelves are desireable.

SUMMARY

The disclosed subject matter relates to a cantilever mounting for connecting a member to a structure, which includes a receiver attachable to the structure, the receiver having a recess and an abutment surface spaced therefrom. An inserter is capable of being attached to the member. The inserter has an insertion leg and an abutment support spaced therefrom, the insertion leg is insertable into the recess of the receiver, the abutment support being capable of resting upon the abutment surface when the insertion leg is in the recess. The weight of the member attached to the inserter pulls the abutment support into engagement with the abutment surface and pushes the insertion leg into engagement with the recess, holding the member at a given orientation relative to the structure.

In accordance with another aspect of the disclosure, the member is a light shelf.

In accordance with another aspect of the disclosure, the light shelf has a base, a panel contacting the base and a frame extending from a first end of the base around the panel to a second end of the base, capturing the panel between the base and the frame.

In accordance with another aspect of the disclosure, the inserter is a first inserter and further including a second inserter to yield a pair of inserters, wherein each inserter of the pair has an attachment leg which projects into the base, the attachment leg of the first inserter projecting into the base at a first end there of and the attachment leg of the second inserter projecting into the base at a second end there of, for attachment there to, each inserter having an extension portion that extends into a corresponding end of the frame for attachment thereto, the pair of inserters connecting the frame to the base, the frame and the base having a groove dimensioned to receive and hold the panel therein.

In accordance with another aspect of the disclosure, the inserter has a bending strength limited to be less than an attachment strength of the receiver to the structure.

In accordance with another aspect of the disclosure, the bending strength is limited by an aperture in the inserter, which reduces the cross-sectional area of the inserter.

In accordance with another aspect of the disclosure, the aperture extends through the inserter proximate the conjunction of the extension and the abutment support in a direction perpendicular to a surface of the abutment support of the inserter that contacts the abutment surface of the receiver when the inserter and receiver are holding the member at a given orientation relative to the structure.

In accordance with another aspect of the disclosure, the aperture extends through the inserter proximate the conjunction of the extension and the abutment support in a direction parallel to a surface of the abutment support of the inserter that contacts the abutment surface of the receiver when the inserter and receiver are holding the member at a given orientation relative to the structure.

In accordance with another aspect of the disclosure, the bending strength is limited by a slot in the inserter, which reduces the cross-sectional area of the inserter proximate the conjunction of the extension and the abutment support.

In accordance with another aspect of the disclosure, the receiver is bilaterally symmetric allowing the receiver to be used in conjunction with an inserter installed on either the left side or the right side of a member.

In accordance with another aspect of the disclosure, the receiver has a mitered side face which extends from the structure at an angle other than 90 degrees.

In accordance with another aspect of the disclosure, a pair of receivers with mitered side faces abut together in a corner to allow the installation of pair of adjacent members in a corner of the structure.

In accordance with another aspect of the disclosure, the mounting includes a pair of receivers and a pair of inserters, the pair of receivers attachable to a structure with a spacing there between, a first of the pair of inserters attachable to one side of the member and a second of the pair of inserters attachable to another side of the member, the spacing of the pair of receivers matching the width of the member to allow the insertion leg of the first and second inserters to engage the recess of the first and second receivers, respectively, to hold the member at the given orientation relative to the structure.

In accordance with another aspect of the disclosure, the abutment surface extends from the structure when attached thereto at an angle other than 90 degrees.

In accordance with another aspect of the disclosure, the structure is not plumb and the angle of the abutment surface compensates for the out-of-plumb condition of the structure to hold the member perpendicular to plumb.

In accordance with another aspect of the disclosure, the angle of the abutment surface is selected to provide a selected orientation of the member relative to plumb.

In accordance with another aspect of the disclosure, an adjustment screw is threaded into an aperture extending through at least one of the abutment support and the receiver, an end of the adjustment screw extending to a selected degree from at least one of the surface of the abutment support and the abutment surface and pressing against at least one of the abutment surface and the abutment support to adjust the orientation of the member.

In accordance with another aspect of the disclosure, the receiver has an upper bracket and a lower bracket extending from an upright portion, the upper and lower brackets being spaced from each other to define a slot there between, the upper bracket having a depending block spaced from the upright portion by the recess, the lower bracket having a floor extending from the upright portion to a lip proximate the abutment surface, the space between the lip and the upper bracket defining a threshold opening through which the insertion leg may enter the slot.

In accordance with another aspect of the disclosure, the mounting includes a pair of receivers and a pair of inserters, a first of the pair of receivers attachable to a structure at a spacing relative to a second of the pair of receivers, a first of the pair of inserters attachable to one side of the member and a second of the pair of inserters attachable to another side of the member, the spacing of the first and second receivers approximating the width of the member to allow the insertion leg of the first and second inserters to engage the recess of the first and second receivers, respectively, to hold the member at the given orientation relative to the structure, wherein the member is a light shelf with a base, a panel contacting the base and a frame extending from a first end of the base around the panel to a second end of the base, capturing the panel between the base and the frame, wherein each inserter of the pair has an attachment leg which projects into the base on the first end and the second end, respectively, for attachment there to and an extension that extends into a corresponding end of the frame for attachment thereto, the inserters intermediating between the frame and the base, the frame and the base having a groove dimensioned to receive and hold the panel therein when the base and the frame are connected to the pair of inserters.

In accordance with another aspect of the disclosure, a method for removably mounting a member to a structure using a cantilever mounting having a pair of spaced receivers attached to the structure, each of the receivers having a recess and an abutment surface spaced there from, and a pair of inserters attached to opposite sides of the member, each of the inserters having an insertion leg and an abutment support spaced there from, wherein each receiver has an upper bracket and a lower bracket extending from an upright portion, the upper and lower brackets being spaced from each other to define a slot there between, the upper bracket having a recess proximate the conjunction of the upright portion and the upper bracket, includes the steps of:

(A) positioning the member and the pair of inserters relative to the pair of receivers;

(B) inserting the insertion leg of each of the pair of inserters into the slot of a corresponding one of the pair of receivers;

(C) raising the member such that the abutment support of the inserter is above the abutment surface of the receiver;

(D) sliding the insertion leg toward the upright portion;

(E) lowering the member to allow the abutment support to contact the abutment surface and pivot the insertion leg up into the recess to hold the member at a given orientation relative to the structure.

In accordance with another aspect of the disclosure, the member is removed from the mounting by (F) lifting the member to pivot the insertion leg down out of the recess and lifting the abutment support of the inserter out of contact with the abutment surface of the receiver;

(G) sliding the insertion leg away from the upright portion; and (H) removing the insertion leg of each of the pair of inserters from the slot of a corresponding one of the pair of receivers.

BRIEF DESCRIPTION OF THE DRAWINGS

For a more complete understanding of the present invention, reference is made to the following detailed description of exemplary embodiments considered in conjunction with the accompanying drawings.

FIG. 8*a* is a perspective, partially phantom view of a inserter in accordance with an alternative embodiment of the present disclosure.

FIG. 8*b* is a top view of the inserter of FIG. 8*a*.

FIG. 9*a* is a perspective, partially phantom view of a inserter in accordance with an alternative embodiment of the present disclosure.

FIG. 9*b* is a top view of the inserter of FIG. 9*a*.

FIG. 10*a* is a perspective, partially phantom view of a inserter in accordance with an alternative embodiment of the present disclosure.

FIG. 10*b* is a top view of the inserter of FIG. 10*a*.

FIG. 10*c* is a side view of the inserter of FIG. 10*a*.

DETAILED DESCRIPTION OF EXEMPLARY EMBODIMENTS

Figure 1:
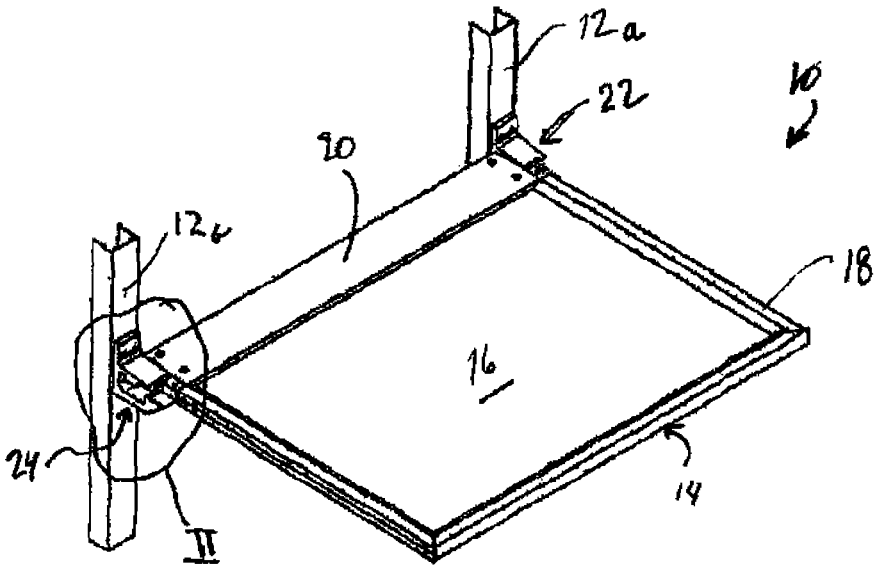
FIG. 1 is a perspective view of a light shelf in accordance with an embodiment of the present disclosure.

FIG. 1 shows a light shelf assembly 10 mounted to structural members 12*a*, 12*b*, e.g., metal studs of a wall of a building or a mounting framework for a plurality or array of light shelves, e.g., stacked one above another with a spacing there between. The assembly 10 may include a shelf 14 with a panel 16 formed from sheet metal, such as aluminum or an aluminized plastic to confer reflectivity to the surface(s) of the panel 16. The panel 16 may be painted with reflective paint, such as aluminum or white paint. In addition, the panel 16 could be made from a polymeric material, which could be translucent or opaque. Alternatively, the panel 16 may be composed of a variety of rigid or flexible materials with a variety of visual characteristics. In the embodiment shown, the panel 16 is supported in a frame 18, e.g., made from extruded aluminum alloy, like that used to make aluminum windows and doors. Alternatively, the frame may be made from other materials, such as plastic, wood, stainless steel or other types of metals. The frame 18 and/or panel 16 is attached to a base member 20 that spans the width of the panel 16 and frame 18. As shall be described further below, the base member 20 is connectable to a structure via mounting assemblies 22, 24.

Figure 2:
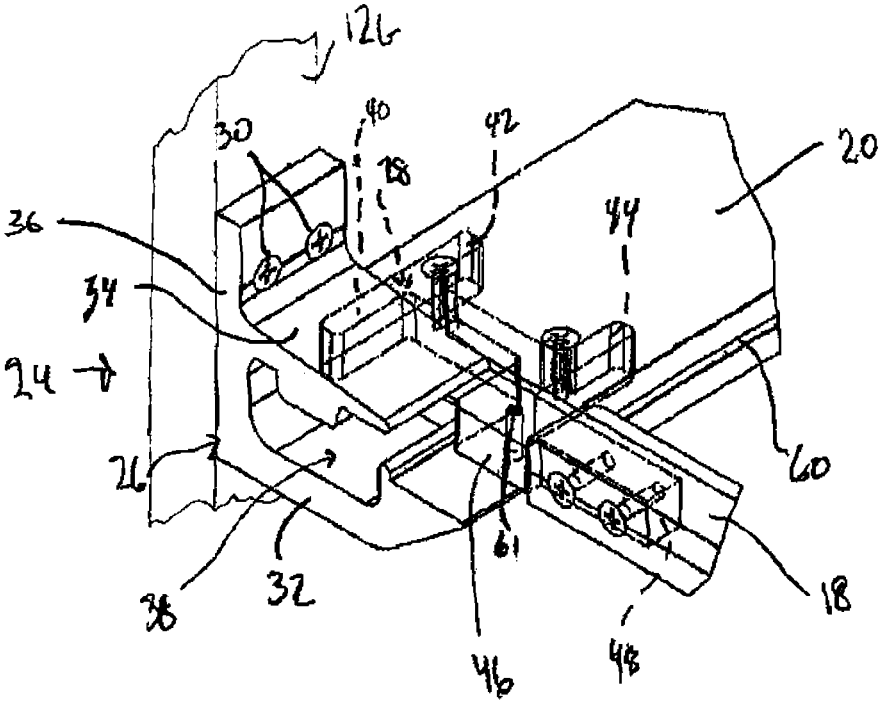
FIG. 2 is an enlarged, partially phantom view of a segment of the light shelf of FIG. 1, showing the mounting apparatus thereof.
Figure 3:
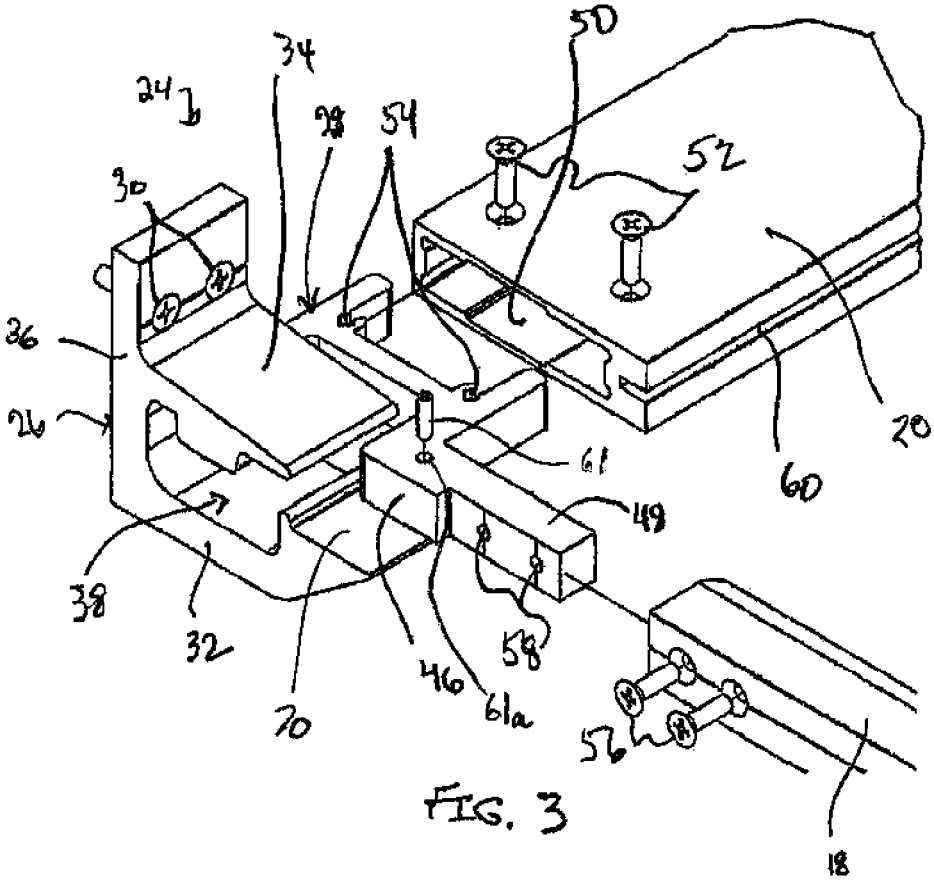
FIG. 3 is an exploded view of the apparatus of FIGS. 1 and 2

FIGS. 2 and 3 show that the mounting assemblies, 22, 24 feature a receiver portion 26 (receiver) and an inserter portion 28 (inserter). The receiver 26 may be fastened to a support member, such as structural member 12*a* or 12*b*, via fasteners 30, such as bolts, screws, rivets, nails, etc. Alternatively, the receiver 26 may have other coupling features, such as integral hooks that insert into apertures in a structural member 12*a* or 12*b*, similar to peg board hooks or other conventional removable shelf hooks. In the embodiment shown, the receiver 26 may be used in both mounting assemblies 22 and 24 to support both sides of the shelf 14, such that specialized right and left receivers are not required. The receiver 26 has a lower bracket 32 and an upper bracket 34 which extend laterally from an upright portion 36, which extends longitudinally and which receives the fasteners 30 to hold the receiver 26 to a structural member 12*a* or 12*b*. As described below in reference to FIG. 11, in another embodiment, the lower bracket 32 and the upper bracket 34 may extend at different angles relative to the upright portion 36 to accommodate different installation requirements. The lower bracket 32 and the upper bracket 34 are separated by a slot 38. The inserter 28 has an insertion leg 40, a pair of base attachment legs 42, 44, and an abutment leg 46 with an extension 48 to which the frame 18 may be attached. As described below in reference to FIGS.

8*a*-10*c*, the inserter 26 may utilize features that promote bending of an overloaded mounting assembly too avoid disengagement from a structural member 12*a*, 12*b*. The inserter 28 may be fastened to a base member 20 by sliding the base attachments legs 42, 44 into a hollow 50 of the base member 20, and retained therein by fasteners 52 that are received in apertures 54. Similarly, the frame 18 is held to the extension 48 by fasteners 56 and apertures 58. A groove 60 may be provided in the base member 20 to receive a panel 16, which is not shown in FIGS. 2 and 3. The depth and width of the groove 60 may be varied to accommodate panels 16 having different sizes and thicknesses. A set screw 61 is received in threaded aperture 61*a* in abutment leg 46 and may be used to adjust the position of the shelf 14, i.e., by encountering abutment support surface 70 and pushing the abutment leg 46 away from the abutment surface 70 to a selected degree.

Figure 4C:
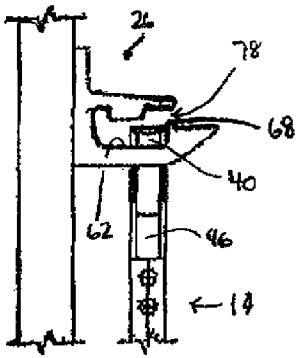
FIGS. 4*a-f* are sequential, diagrammatic views of the cooperation of elements of the apparatus of FIGS. 1-3.
Figure 4F:
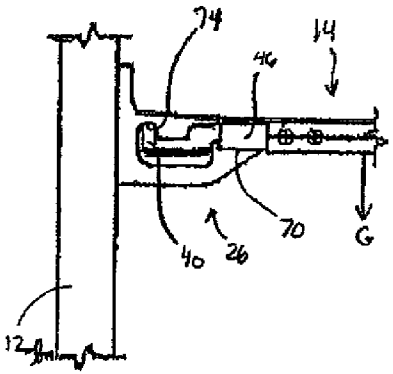
Figure 4B:
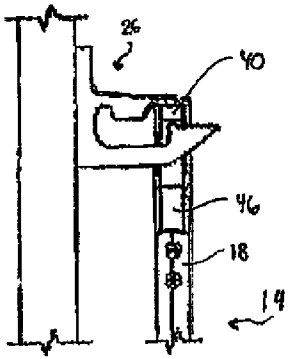
Figure 4E:
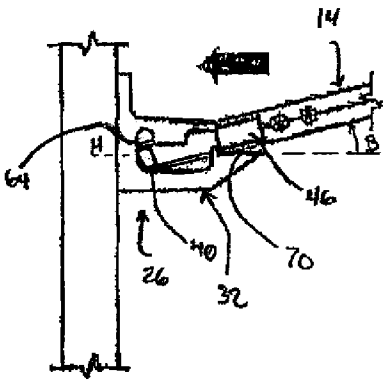
Figure 4A:
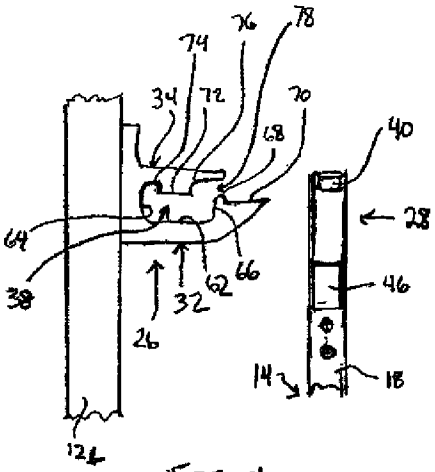

FIG. 4*a* shows a receiver 26 fastened to a structural member 12*b* juxtaposed next to an inserter 28. The inserter 28 has an insertion leg 40 and an abutment leg 46. A frame 18 is attached to the inserter 28 and depends downwardly therefrom for supporting a panel 16 (not depicted) of a shelf 14. The shelf 14 would typically be held by a person (installer) in their hands and lifted and moved through the sequence of movements shown in FIGS. 4*a*-4*f* in order to assemble and position the inserter 28 into the receiver 26 to hold the shelf 14 at a desired position. The lower bracket 32 of the receiver 26 has a floor 62 extending between a back wall 64 and a front wall 66, which extends upwardly to form a lip 68. The lip 68 is adjacent an abutment support surface 70. The upper bracket 34 has a downwardly depending block 72 which defines a recess 74 proximate back wall 64 and a relief 76 opposite to the lip 68 of the lower bracket 32, which defining a threshold gap 78 through which the insertion leg 40 may be passed into the slot 38.

FIG. 4*b* shows the insertion leg 40 as it is inserted into the threshold gap 78. In the embodiment shown, the insertion leg 40 has a rectangular cross-section, such that the insertion leg will only clear the threshold gap 78 if held in the orientation depicted, i.e., with the smaller dimension of the rectangular cross-section of the insertion leg 40 parallel to the threshold gap 78, i.e. extending across the gap 78. This dimensional relationship may be used to control the angle at which the insertion leg 40 may be passed into and out of the slot 38, e.g., to prevent inadvertent removal during assembly, adjustment and disassembly of the light shelf assembly 10 (and consequently the orientations of the shelf 14 that enable/disable these functions). In the embodiment shown in FIG. 4*b*. the shelf 14 is perpendicular to the horizon/ground for insertion. The threshold gap 78 may be modified to permit/require different angles of insertion of the insertion leg 40 and may be enlarged so as to allow insertion at any angle.

As shown in FIG. 4*c*. once past the threshold gap 78, the insertion leg 40 may drop down and rest on the floor 62 proximate the lip 68. Since a pair of mounting assemblies 22, 24 may be used to support a shelf 14, the engagement between the inserter portion 28 and the receiver portion 26 may take place on the mounting assemblies 22, 24 on opposite sides of the base member 20, such that the shelf 14 may be hung in the position shown in FIG. 4*c* without the support of a person. The installer can therefore release the light shelf 10 and it will hang from the assemblies 22, 24.

Figure 4D:
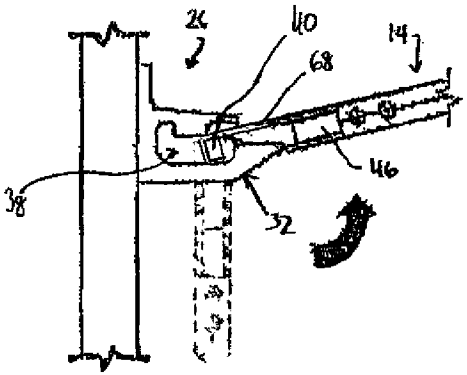

FIGS. 4*d* and 4*e* show that the shelf 14 can be pivoted up on the insertion leg 40 within the slot 38 and slid back until the insertion leg 40 encounters back wall 64. As shown in FIG. 4*d*. the pivoting of the insertion leg 40 is conducted while the insertion leg 40 is positioned proximate the lip 68, allowing the abutment leg 46 to clear the lower bracket 32 as it swings upward. FIG. 4*e* shows that once the abutment leg 46 is clear of the lower bracket 32 and held at an angle B relative to the horizontal H, the insertion leg 40 can be slid back to the rear wall 64, bringing the abutment block 46 over the abutment support surface 70.

FIG. 4*f* shows that when the shelf 14 is then swung down to the horizontal position, the abutment leg 46 or the adjustment set screw 61 (see FIG. 3) comes to rest upon the abutment support surface 70 and the insertion leg 40 pivots up into engagement with the recess 74 and is held in that position by the force of gravity G. The insertion leg 40 engaging the recess 74 resists forces directed perpendicular to the support member 12*b*, and in cooperation with the abutment leg 46 and abutment support surface 70, provides a cantilevered mounting for the shelf 14, which is held in a horizontal orientation. If removal of the shelf 14 is desired, it can readily be accomplished by reversing the foregoing procedure. As can be appreciated, the shelf 14 can be adjusted between a depending orientation to a horizontal orientation and installed and removed from a mounted receiver 26 without tools. Referring to FIGS. 2 and 3, one or more set screws 79 may be used to adjust the angle of the shelf 14. More particularly, the degree to which the set screw 79 protrudes through the abutment leg 46 and pushes the abutment leg away from the abutment surface 70 can be adjusted by turning the screw 79 in or out, varying the angle of the shelf 14 relative to the horizontal orientation.

Figure 5:
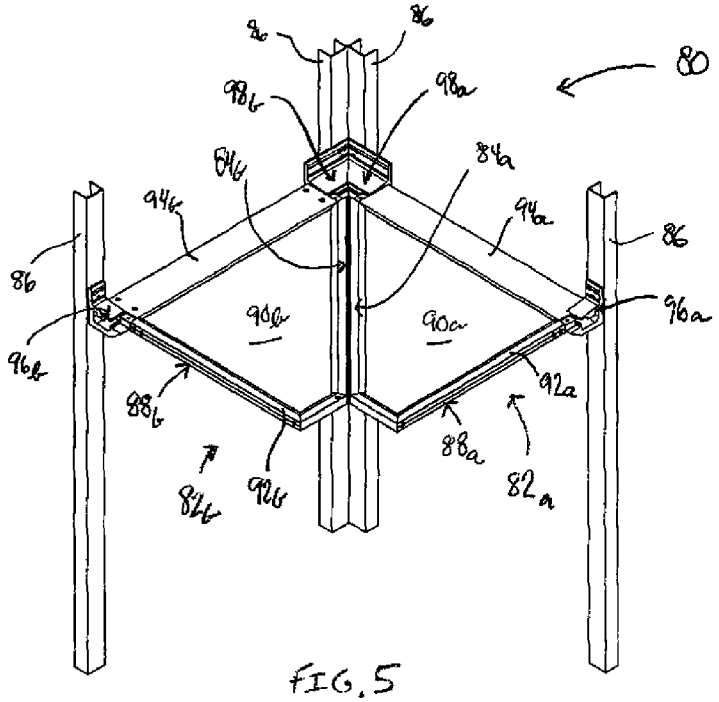
FIG. 5 is a plan view of a pair of light shelves installed in a corner of a structure in accordance with another embodiment of the disclosure.

FIG. 5 shows a corner 80, e.g., of a room in which a pair of light shelf assemblies 82*a*, 82*b* have been installed. The light shelf assemblies 82*a*, 82*b* have similar features as the light shelf assembly 10 described above in reference to FIGS. 1-4, except for mitered edges 84*a*, 84*b*, which allow close relative juxtaposition in corner 80. As before, the light shelf assemblies 82*a*, 82*b* are mounted to structural members 86, e.g., studs of a wall of a building or a mounting framework for a plurality or array of light shelves. The light shelf assemblies 82*a*, 82*b* may include a shelf 88*a*, 88*b*, with a panel 90*a*, 90*b*, respectively, formed from the same type of materials described above in reference to the embodiment shown in FIG. 1. The panels 90*a*, 90*b* may be supported in a corresponding frame 92*a*, 92*b*, respectively, e.g., made from extruded aluminum alloy, like that used to make aluminum windows and doors. Alternatively, the frame 92*a*, 92*b* may be made from other materials, such as plastic, wood, stainless steel or other types of metals. The frames 92*a*, 92*b* and/or panels 90*a*, 90*b* are attached to base members 94*a*, 94*b*. As before, the base members 94 and 94*b* are connectable to a structure via mounting assemblies 96*a*, 96*b* that are like the mounting assemblies 22, 24 described above, but also by mitered corner mounting assemblies 98*a*, 98*b* that have features providing a relative mitered fit one to another.

Figure 6:
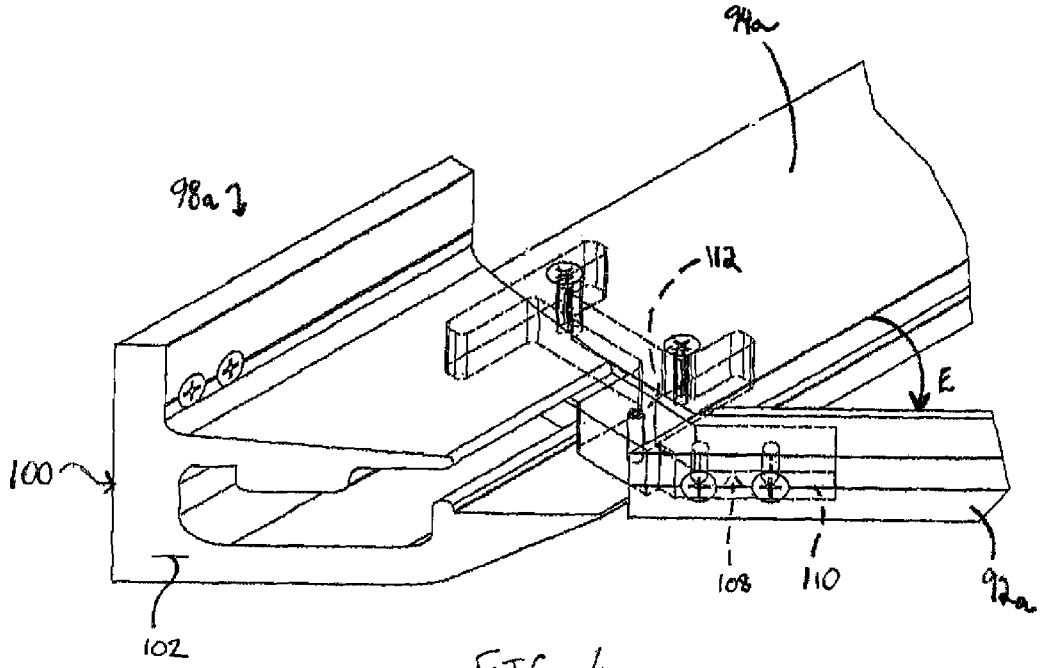
FIG. 6 is an enlarged, partially phantom view, like FIG. 2, of an alternative embodiment of the present disclosure.
Figure 7:
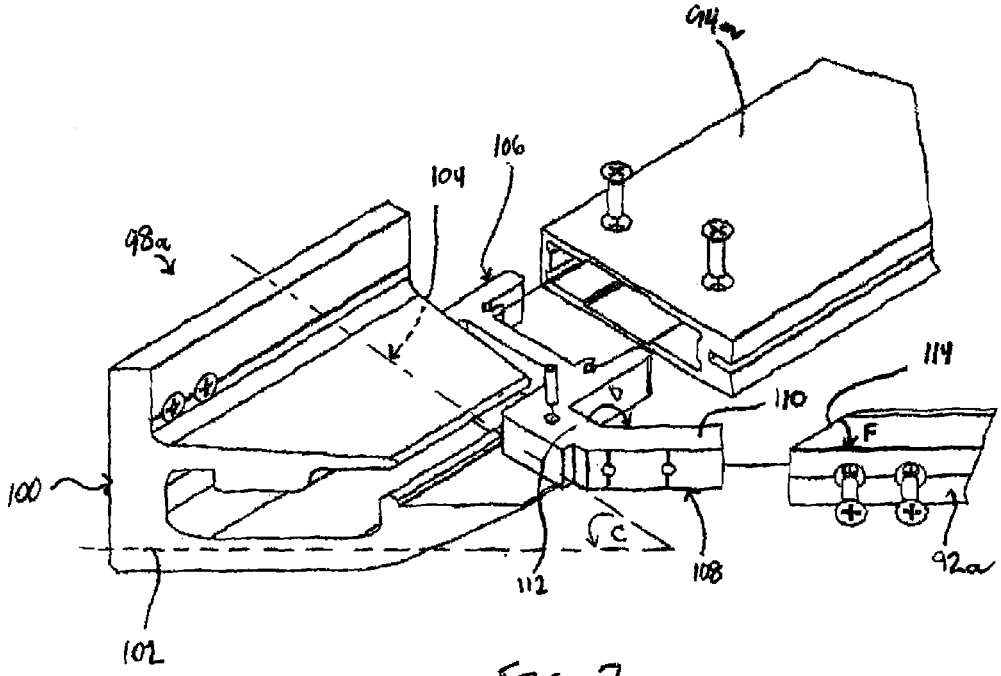
FIG. 7 is an exploded view of the apparatus of FIG. 6.

FIGS. 6 and 7 show that the mitered mounting assemblies, 98*a*, 98*b* feature a receiver portion 100 having a mitered face 102 which is disposed at angle C, e.g., 45 degrees relative to opposing face 104. The inserter portion 106 features an extension 108 with a distal portion 110 that extends from a root portion 112 at an angle D, e.g., 135 degrees. The angled extension 108 holds frame 92*a* at acute angle E, e.g., 45 degrees, relative to base member 94*a* when coupled to the inserter portion 106. End 114 of frame 92*a* is cut at an angle F, e.g., 45 degrees, to cover distal portion 110 up to the root portion 112. As shown in FIG. 5, the mitered mounting assemblies 98*a*, 98*b* are mirror images of one another, such that they conjoin in a complementary, mitered relationship to fit in corner 80. Beyond the foregoing differences, the mitered mounting assemblies 98*a*, 98*b* are constructed and function in a similar manner to the mounting assemblies 22, 24 described above in relation to FIGS. 1-4.

Each of FIGS. 8*a*-10*c* show inserters 120. 130. 140, respectively, which have the same basic form and function as the inserters 28 and 106 described above with respect to FIGS. 1-7, but illustrating different approaches to limiting the bending strength thereof. More particularly, FIGS. 8*a* and 8*b* show an inserter 120 having an aperture 122 extending through the inserter 120 proximate the junction of the extension 126 and the abutment leg 128 and having an orientation approximately perpendicular to the threaded aperture 124 (which would receive an adjustment set screw (not shown) like screw 61 of FIG. 3). The aperture 122 is dimensioned to reduce the bending strength of the inserter 120, such that the extension 126 is likely to bend relative to the abutment leg 128 prior to the failure of mounting screws 30 (See FIG. 3) holding a cooperating receiver 26, e.g., as shown in FIG. 3. In the instance of an unexpected loading of a light shelf, e.g., 14 or 88*a*, e.g., due to an installer pulling on the shelf 14 or 88*a*, bending is preferred in that it occurs more gradually, allowing perception of the bending movement and corrective action to be taken (encouraging the installer to stop pulling on the shelf. In addition, early bending limits the amount of force that can build up in the system.

Figure 11:
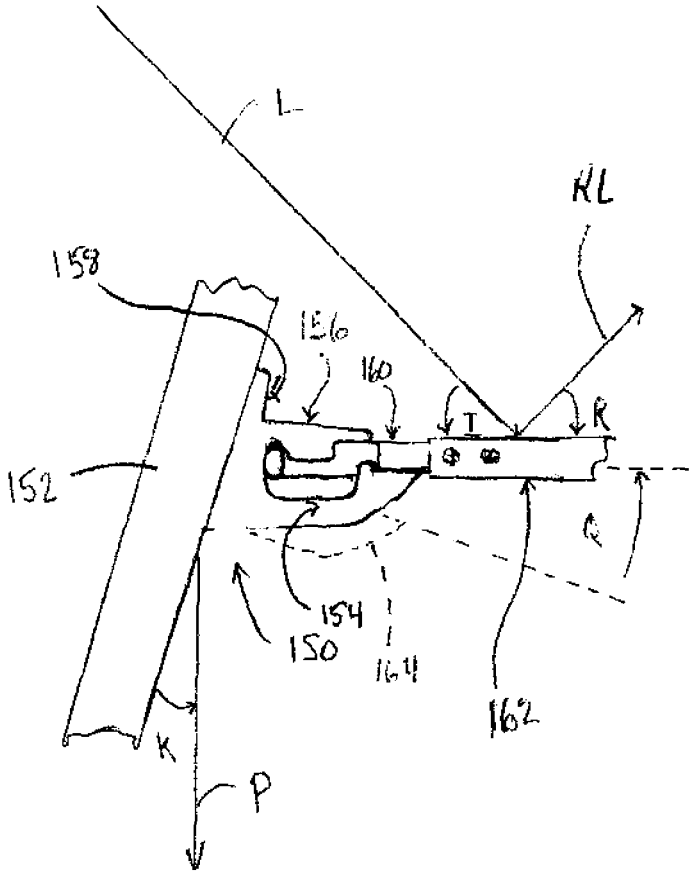
FIG. 11 is a diagrammatic side view of an alternative embodiment of a portion of a light shelf mounting assembly in accordance with the present disclosure.

FIG. 11 shows a receiver 150 affixed to a structural member 152 that is disposed at an angle K relative to plumb P. The receiver 150 has a lower bracket 154 and an upper bracket 156 that extend from the base attachment leg 158 at an angle that, in cooperation with an inserter 160 supports the light shelf 162 in a horizontal orientation. A receiver 26 like that shown in FIGS. 2 and 3 would have an orientation like that illustrated by the lower bracket 164 shown in dotted lines, if installed on an angled structural member 152 and would require a reorientation through angle Q, in order to hold the shelf horizontal. A receiver 26, 152 may be selected with a lower bracket 32, 154 and upper bracket 34, 156 orientation that provides a desired incidence angle I and reflection angle R for light L, such that the reflected light RL is directed to a desired location within a given building for any given structural member 12*a*, 152 orientation.

It will be understood that the embodiments described herein are merely exemplary and that a person skilled in the art may make many variations and modifications without departing from the spirit and scope of the claimed subject matter. For example, while the disclosure has been expressed in terms of apparatus for supporting light shelves, the apparatus disclosed herein could be utilized to support other types of horizontal members, shelves and support surfaces, e.g., storage shelves. All such variations and modifications are intended to be included within the scope of the appended claims.

We claim:

1. A cantilever mounting for connecting a member to a structure, comprises:

(A) a pair of receivers, each attachable to the structure with a spacing there between, each receiver having a recess and an abutment surface spaced there from;

(B) a pair of inserters, each attachable to the member, each inserter having an insertion leg and an abutment support spaced there from, the insertion leg insertable into the recess of the receiver, the abutment support capable of resting upon the abutment surface when the insertion leg is in the recess, the weight of the member attached to the inserter capable of pulling the abutment support down into engagement with the abutment surface and rotating the insertion leg up into engagement with the recess, holding the member at a given orientation relative to the structure, a first of the pair of inserters attachable to one side of the member and a second of the pair of inserters attachable to another side of the member, the insertion legs of the first inserter and the second inserter extending distal to the member, the insertion leg of the first inserter extending in a direction opposite to the insertion leg of the second inserter, the spacing of the pair of receivers approximating the width of the member to allow the member to be positioned between the pair of receivers with the insertion legs of the first and second inserters engaging the recesses of a first and a second of the pair of receivers, respectively, to hold the member at the given orientation relative to the structure, each receiver having an upright portion, an upper bracket and a lower bracket extending from the upright portion, the upper bracket and lower bracket being spaced from each other to define a slot there between that communicates with the recess, the upper bracket having a depending block spaced from the upright portion by the recess, the lower bracket having a floor extending from the upright portion to proximate the abutment surface, the slots of the spaced receivers capable of cooperating with the insertion legs of the inserters to support the member in a pendulous orientation when the insertion legs are positioned therein at a position distal to the recess, each of the insertion legs of the pair of inserters capable of traversing a corresponding slot of the pair of receivers from the position distal to the recess to the recess and of rotating in the slot.

2. The cantilever mounting of claim 1, wherein the member is a light shelf.

3. The cantilever mounting of claim 2, wherein the light shelf has a base, a panel contacting the base and a frame extending from a first end of the base around the panel to a second end of the base, capturing the panel between the base and the frame.

4. The cantilever mounting of claim 3, wherein each inserter of the pair has an attachment leg which projects into the base, the attachment leg of the first inserter projecting into the base at a first end there of and the attachment leg of the second inserter projecting into the base at a second end there of, for attachment there to, each inserter having an extension portion that extends into a corresponding end of the frame for attachment thereto, the pair of inserters connecting the frame to the base, the frame and the base having a groove dimensioned to receive and hold the panel therein.

5. The apparatus of claim 4, wherein each inserter has a bending strength limited by an aperture in the inserter, which reduces the cross-sectional area of the inserter.

6. The apparatus of claim 5, wherein the aperture extends through the inserter proximate the conjunction of the extension and the abutment support in a direction perpendicular to a surface of the abutment support of the inserter that contacts the abutment surface of the receiver when the inserter and receiver are holding the member at a given orientation relative to the structure.

7. The apparatus of claim 5, wherein the aperture extends through the inserter proximate the conjunction of the extension and the abutment support in a direction parallel to a surface of the abutment support of the inserter that contacts the abutment surface of the receiver when the inserter and receiver are holding the member at a given orientation relative to the structure.

8. The apparatus of claim 4, wherein each inserter has a bending strength limited by a slot in the inserter, which reduces the cross-sectional area of the inserter proximate the conjunction of the extension and the abutment support.

9. The cantilever mounting of claim 1, wherein each inserter has a bending strength limited to be less than an attachment strength of a corresponding receiver to the structure.

10. The cantilever mounting of claim 1, wherein each receiver is bilaterally symmetric allowing each receiver to be used in conjunction with an inserter installed on either a left side or a right side of the member.

11. The cantilever mounting of claim 1 further comprising an adjustment screw threaded into an aperture extending through at least one of the abutment support and the receiver, an end of the adjustment screw extending to a selected degree from at least one of the surface of the abutment support and the abutment surface and pressing against at least one of the abutment surface and the abutment support to adjust the orientation of the member.

12. The cantilever mounting of claim 1, wherein each receiver has a lip proximate the abutment surface, the space between the lip and the upper bracket defining a threshold opening through which the insertion leg may enter the slot.

13. The cantilever mounting of claim 12, wherein the member is a light shelf with a base, a panel contacting the base and a frame extending from a first end of the base around the panel to a second end of the base, capturing the panel between the base and the frame, wherein each inserter of the pair has an attachment leg which projects into the base on the first end and the second end, respectively, for attachment there to and an extension that extends into a corresponding end of the frame for attachment thereto, the inserters intermediating between the frame and the base, the frame and the base having a groove dimensioned to receive and hold the panel therein when the base and the frame are connected to the pair of inserters.

14. The apparatus of claim 1, wherein at least one of the pair of receivers has a mitered side face which extends from the structure at an angle other than 90 degrees.

15. The apparatus of claim 14, wherein a pair of receivers with mitered side faces abut together in a corner to allow the installation of pair of adjacent members in a corner of the structure.

16. The apparatus of claim 1, wherein the abutment surface of each of the pair of receivers extends from the structure when attached thereto at an angle other than 90 degrees.

17. The apparatus of claim 16, wherein the structure is not plumb and the angle of the abutment surface compensates for the out-of-plumb condition of the structure to hold the member perpendicular to plumb.

18. The apparatus of claim 16, wherein the angle of the abutment surface is selected to provide a selected orientation of the member relative to plumb.

19. A method for removably mounting a member to a structure using a cantilever mounting having a pair of spaced receivers attached to the structure, each of the receivers having a recess and an abutment surface spaced there from, and a pair of inserters attached to opposite sides of the member, each of the inserters having an insertion leg and an abutment support spaced there from, wherein each receiver has an upper bracket and a lower bracket extending from an upright portion, the upper and lower brackets being spaced from each other to define a slot there between, the upper bracket having a recess proximate the conjunction of the upright portion and the upper bracket, comprising the steps of :

(A) positioning the member and the pair of inserters relative to the pair of receivers;

(B) inserting the insertion leg of each of the pair of inserters into the slot of a corresponding one of the pair of receivers, the member being positioned between the pair of receivers;

(C) raising the member such that the abutment support of each inserter is above the abutment surface of a corresponding receiver;

(D) sliding each insertion leg in the slot of the corresponding receiver toward the upright portion;

(E) lowering the member to allow the abutment support to contact the abutment surface and pivot the insertion leg up into the recess to hold the member at a given orientation relative to the structure.

20. The method of claim 19, further comprising removing the member from the mounting by (F) lifting the member to pivot the insertion leg down out of the recess and lifting the abutment support of the inserter out of contact with the abutment surface of the receiver;

(G) sliding the insertion leg in the slot away from the upright portion; and (H) removing the insertion leg of each of the pair of inserters from the slot of a corresponding one of the pair of receivers.

21. The method of claim 20, further comprising the step of rotating the member to an orientation proximate a pendulous orientation before the step of removing.

22. The method of claim 20, further comprising the step of permitting the member to hang in a pendulous position after the step (B) of inserting and before the step (H) of removing.

23. The method of claim 19, wherein the step of raising includes rotating the member from a pendulous position to a position above the horizontal orientation when the insertion legs are positioned in the slots distal to the recesses, the insertion legs rotating in the slots.

* * * * *